United States Patent [19]

Koehl

[11] 4,019,328

[45] Apr. 26, 1977

[54] ARRANGEMENT FOR MAKING A PREFABRICATED WALL

[76] Inventor: Jean Marie Gérard Koehl, 3, rue Varengue 92340, Bourg-la-Reine, France

[22] Filed: Dec. 8, 1975

[21] Appl. No.: 638,351

[52] U.S. Cl. ..... 61/41 A; 52/496

[51] Int. Cl.[2] ..... E02D 5/00

[58] Field of Search ..... 61/41, 41 A, 39, 60, 61/61; 52/461, 495, 496

[56] References Cited

UNITED STATES PATENTS

| | | | |
|---|---|---|---|
| 3,530,679 | 9/1970 | Krings | 61/39 R |
| 3,910,054 | 10/1975 | Krings | 61/41 A |

FOREIGN PATENTS OR APPLICATIONS

| | | | |
|---|---|---|---|
| 243,905 | 3/1963 | Australia | 52/461 |

*Primary Examiner*—John E. Murtagh
*Attorney, Agent, or Firm*—Walter Becker

[57] ABSTRACT

The arrangement comprises a plurality of I-shaped sections associated with a plurality of panels. The panels are provided at least at one end thereof with guiding means engaged in a groove constituted by a wing of the I-shaped section. The web of the I-shaped section and the end of a C-shaped section are slidable along a wing of the I-shaped section and may be blocked at a desired position.

11 Claims, 7 Drawing Figures

ARRANGEMENT FOR MAKING A PREFABRICATED WALL

The present invention relates to an arrangement for making a pre-fabricated wall, and more particularly for making a wall of the type utilized for the support of a ground during an excavation process, for example for timbering a trench.

There are already known arrangement of this type comprising for example rectangular plane elements having, on two of their opposite edges, guiding elements of a male or a female type able of cooperating with complementary guiding means, fixedly mounted for example on a post. To ensure a positive guiding both in the wall plane and perpendicularly to the wall thus constituted, there is in general provided a guiding of each plane element with only one degree of freedom, which involves a realization of relatively complicated guiding elements, for example grooves shaped as a T with male elements engaged in the grooves. Such arrangements are of a costly realization and are submitted to possible damages.

Besides, staying of the walls so erected involves the use of staying means cooperating with bearing elements provided for that purpose on the plane elements of the wall and/or on the posts that it may comprise. The realization and service of the walls are thus complicated because of the requirement to provide such bearing elements.

The present invention has for its purpose to cope with these disadvantages, particularly so to simplify the realization and the embodiment of guiding means of the above mentioned type enabling to said elements to cooperate together and constitute a wall.

For that purpose, the invention has for its object an arrangement for making a pre-fabricated wall characterized in that it comprises a section having a T-shaped wing parallely placed to said wall, typically a wing of a I-shaped section, a C-shaped section with a plane web and two wings having respective ends comprising a portion bent parallel to the web of said C-shaped section, one of the wings of the I-shaped section being engageable inside the C-shaped section in such a way that said ends constitute, with the web of the I-shaped section and the inner surface of the wing of said section when engaged in the C-shaped section, at least one groove-shaped interval, and a substantially plane element provided at least at one of the ends thereof with a guiding means angularly placed to a wall of said substantially plane element, said substantially plane element being engaged between the wings of the I-shaped section in such a way that said guiding means is engaged in said groove when a wall of said element opposite the wall provided with said guiding is brought in contact with the wing of the I-shaped section opposite the wing engaged in the C-shaped section.

According to an advantageous feature, said I-shaped section is fixed to the end of a substantially plane element, the opposite end of said substantially plane element comprising said guiding means, said wall being made by assembling a plurality of elements assembled two by two at right angles of the ends cooperating by a C-shaped section.

Other features will become apparent from the following disclosure given only as an example with reference to the figures of the accompanying drawings in which.

Figure 1:
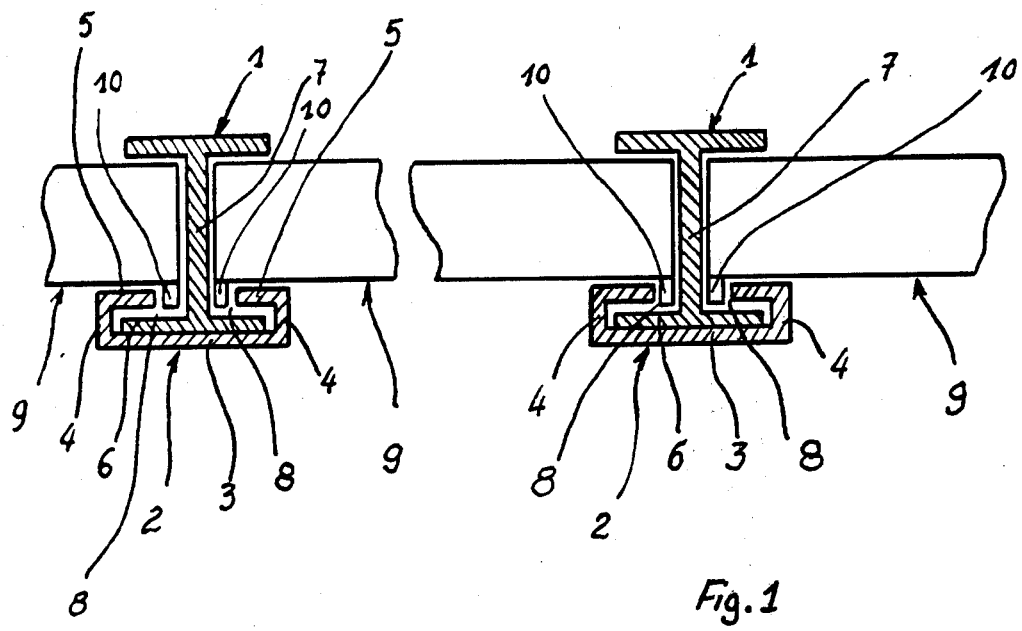
FIG. 1 shows a first embodiment of a wall according to the invention.

FIG. 1 shows a wall of prefabricated plane elements 9 comprising a plurality of posts 1. The posts 1 are constituted by I-shaped sections of the trade preferably sections with parallel wings, equally and parallely spaced one with respect to the other. Each of the I-shaped sections cooperates with a C-shaped section 2 having a plane web 3 and two wings 4, the respective ends of which comprise a portion 5 bent parallel to the web of said C-shaped section. One of the wings, for example the wing 6 of each I-shaped section is engaged inside the attaching C-shaped section in such a way that the bent ends 5 constitute, with the web 7 of the corresponding I-shaped section and the inner surface of the wing 6 of said section, a groove-shaped interval 8. The plane elements 9 are constituted by rectangular plates solid or reassembled by assembling of relatively thin elements on a supporting frame and they comprise on two of their opposite parallel edges, guiding means 10 placed perpendicularly to the wall of said plane elements. The length of the plates is such that said plates can be respectively inserted between two successive posts with the guiding means 10 being engaged into the grooves 8, the end of the plates coming in front of the web of the I-shaped sections, and the wall of said plates opposite to the wall provided with the guiding elements being in front of the wing of the I-shaped section opposite the wing 6 of said section engaged into the C-shaped section. It may thus be understood that each plate can slide along adjacent posts, having — except for the clearances — only 1° of freedom. The C-shaped sections can constitute continuous elements cooperating with the wings of the posts on all their length or, preferably, they can constitute discontinuous guiding zones distributed in a desired manner along the posts. The C-shaped sections can be blocked at the desired position along the wings of the posts by any known means, and preferably by simple grip under action of a pressure means acting either to press the bent portions of the C against the inner surface of the wing of the I, or, on the contrary, to press the web of the C against the outer surface of said wing, or still to press the bent portions of the C against the plane elements. It must be understood that the present embodiment shows a C-shaped section cooperating with a wing of a I-shaped section, but that, for a mere reason of symmetry, it can be thought to constitute in the vicinity of the opposite wing an interval in the shape of a groove to receive a guiding means perpendicular to the wall of the plane element, in order to obtain a guiding process on the two sides of said element, this without departing from the scope of the present invention. Also, the element of the wall can exhibit with regard to the wings of the I-shaped section, a generally angular direction, or the guiding means can, itself, be angularly mounted with respect to said plane element, such variants being still within the understanding of the man of the Art taking into consideration the teaching of this present invention.

Figure 2:
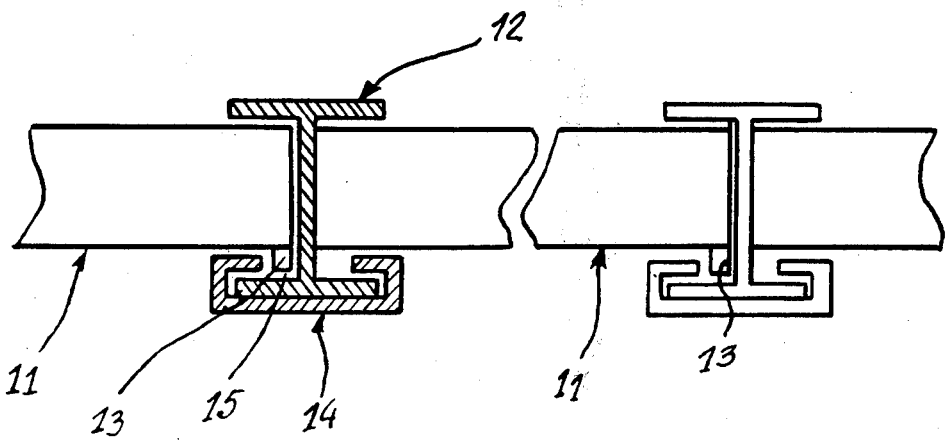
FIG. 2 shows a second embodiment of a wall according to the invention.

FIG. 2 shows another embodiment of a wall made according to the invention, according to which the wall is constituted by assembling plane rectangular elements 11 comprising on each of their wings a I-shaped section 12 and, on the opposite edge, guiding means 13 angularly mounted with respect to the respective wall of said plane elements, that is perpendicular to said wall. It is well understood that the juxtaposition of a plurality of plane elements of the type represented enables to make a wall, each I-shaped section fixed with an edge being able to constitute with a C-shaped section 14 of the previously described type a groove 15 into which are engaged the guiding means 13 of the adjacent plane element.

Figure 3:
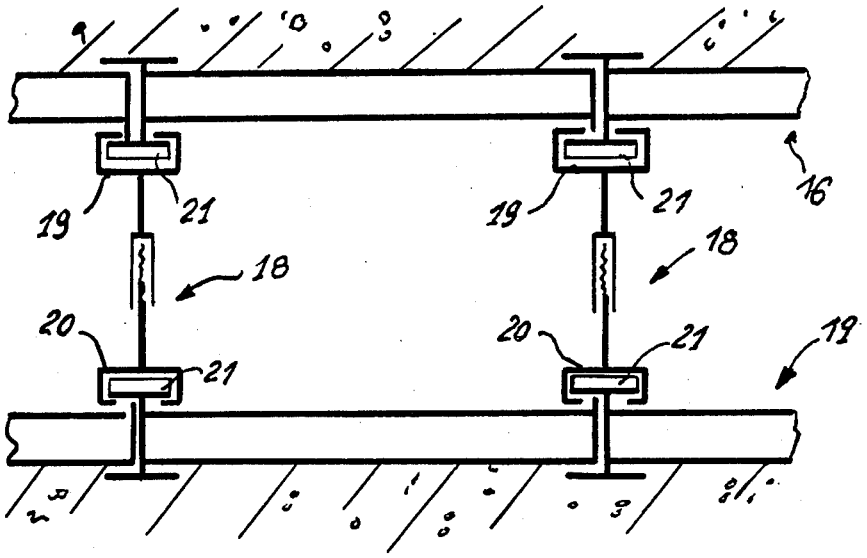
FIG. 3 shows an embodiment of a double wall fitted with a strutting and staying device.

FIG. 3 shows a double wall made by two parallel walls 16 and 17 constituted as illustrated in the drawing of FIG. 2 in reference with the corresponding disclosure and applied in the present case for timbering a trench made in the ground. As this is known, the walls 16 and 17 are tied by struts 18 of adjustable length and of which the respective ends are fixed to the extrados or outer surfaces of the webs of the C-shaped sections 19 and 20 of the type previously described with reference to FIG. 1. The C-shaped sections can thus either slide freely along the wings of the opposite I-shaped sections belonging respectively to each of the timbering walls, or be stopped in the desired position by setting the struts into extension, the intrados or inner surfaces of the webs of the C-shaped sections then bearing against the outer surface of the wings of the opposite I-shaped sections. In order to facilitate the motion of the C-shaped sections along the wings of the I-shaped sections, it is possible to place inside the C-shaped sections, rolling means constituted in the present case by rollers 21 which enable to move the struts while maintaining a certain pressure against the wings of the I. The extension of the struts can be obtained in a known way by a screw-nut system which has only be diagrammatically represented to let the drawing clear, or still by jacks or by any other suitable means.

Figure 4:
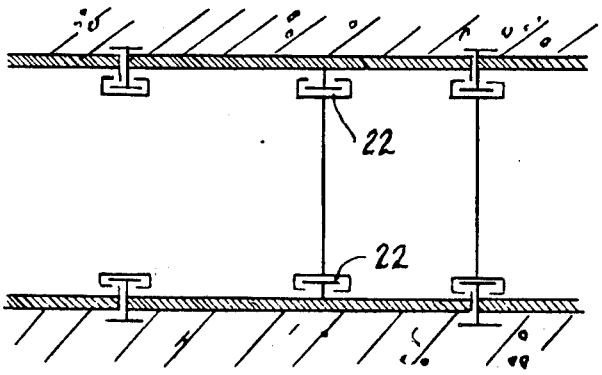
FIG. 4 shows an embodiment of a double wall with staying elements placed intermediate between the ends of the plane elements.

FIG. 4 diagrammatically shows a double wall comprising intermediate staying elements placed between the ends of the plane elements constituting the walls; said staying elements are constituted by struts able to cooperate, as previously indicated, with the extrados of the web of C-shaped sections. The wall elements comprise, at the desired place, an appearing wing 22 constituted for example by the wing of a I-shaped section or by the wing of a T-shaped section, fixed to said element and able to cooperate with said C-shaped elements in a previously indicated manner. Placing intermediate staying elements enables a removal of an end staying element while maintaining the wall element bearing for example against a ground without any risk of untimely collapse of the ground. Any known device provided for an intermediate staying can be used; however, the use of struts of uniform type constitutes an advantageous arrangement, though the C-shaped sections do not constitute, in the present case, by cooperating with the appearing wing of the intermediate section, a guiding device according to this present invention.

Figure 5:
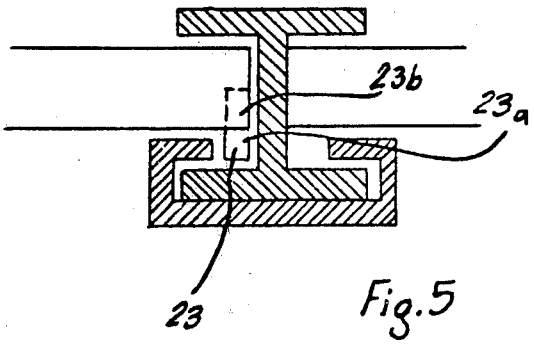
FIG. 5 shows an embodiment of a wall comprising a plane element provided with a retractable guiding component.

FIG. 5 shows a wall element provided with a retractable guiding device 23 added to the end of the wall element, to take a first position shown in 23*a* protruding perpendicularly to the surface of said element, and thus constitute a guiding means as the one previously described, and a second position illustrated in 23*b* according to which said guiding device is concealed with respect to the surface of said wall element. This device enables the operator to obtain a guiding process with a degree of freedom used for example for the penetration of a plane element constituting a timbering panel of a trench, or a guiding process with various degrees of freedom used for example for the extraction of said panel to facilitate the extraction process.

Figure 6:
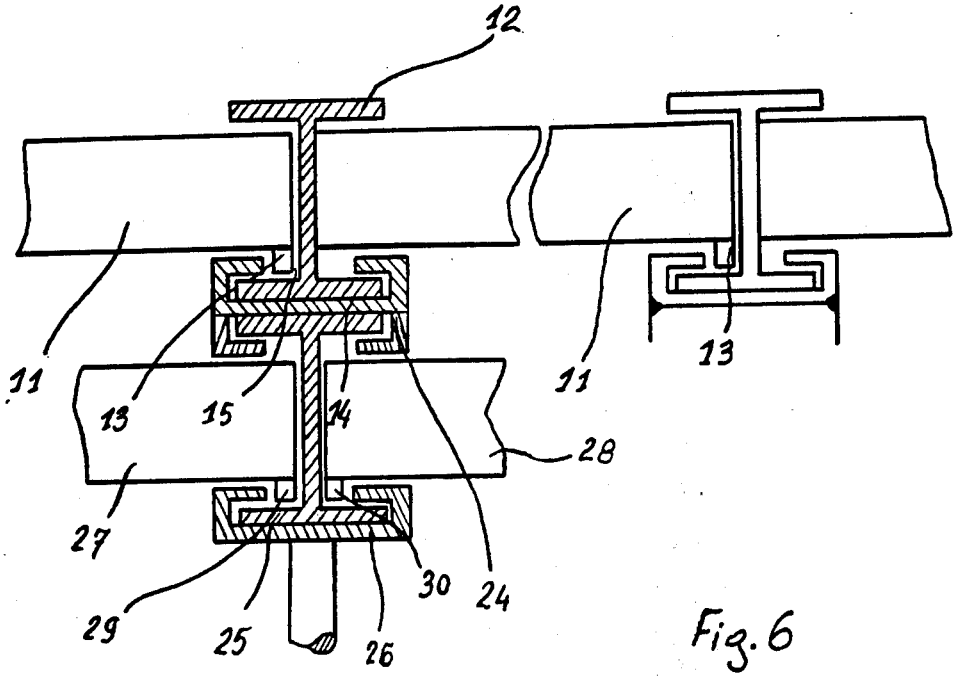

FIG. 6 shows another variant of embodiment of a device according to the invention, this variant can be embodied for making a telescopic wall, as it will be better seen from the following description.

The device shown in FIG. 6 constitutes an extension of the embodiment of the arrangement represented in FIG. 2, thus the same elements are marked in FIGS. 2 and 6 with the same reference numbers. According to the described variant, a C-shaped section 24 is fixedly mounted, for example by welding, to the C-shaped section 14 whereby the respective webs of said sections are located in front of each other. A double guiding means is thus constituted, the C-shaped section 14 cooperating with the inner wing of the I-shaped section 12 and the C-shaped section 24 constituting a guiding element for the outer wing of a I-shaped section 25 which can be a post or the end of a panel. In the present case, the section 25 is a post. This section can itself then provide in cooperating with a C-shaped section 26, a guiding element for ends of panels 27, 28 provided with guiding means 29 and 30 typically of the type previously described in the other embodiments.

The C-shaped section 26 can constitute the bearing end of a strut. The way of utilization of a wall so constituted appears clearly from FIG. 6. The panels 11 associated to the sections 12 and 14 in the previously indicated way constitute a wall which can be used as a support for a trench formed at a certain depth. The sections 24 are used as guides for posts 25 which themselves enable by cooperating with the sections 26, to constitute a wall comprising the sliding panels 27 and 28 which are positioned and extracted according to the same principle as for the panels 11. There can thus be constituted a wall which is formed at a depth more important than the depth determined by the height of the panels 11. Upon filling up the trench, the panels 27 and 28, etc. . . constituting the lower wall portion are first removed, the panels 11 still maintaining the grounds of the upper portion of the trench. The staying continuity on the whole height of the trench is, as it can be seen, provided by struts; in the local area provided for covering up the upper portion and the lower portion of wall, the compression stress exerted by the struts on the section 25 are transmitted by the double C 14 and 24 to the section 12, to constitutes a vertical bearing line for the whole wall on its whole height.

Figure 7:
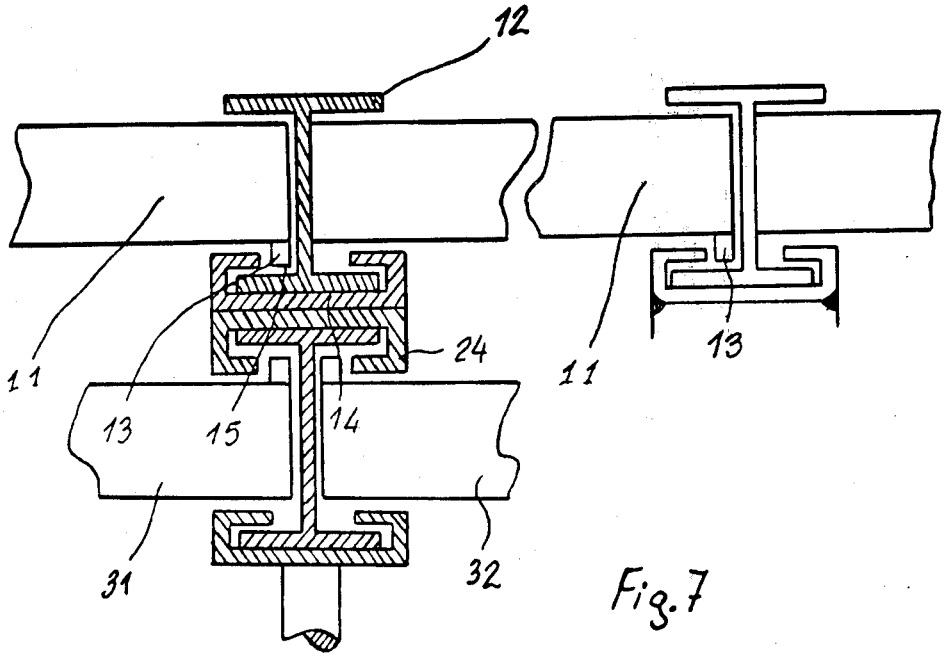

FIG. 7 shows another variant for the embodiment of a telescopic wall in order to illustrate another possibility of use of the guiding means constituted by the association of the wing of a T-shaped or I-shaped section with a C-shaped section according to the invention. The variant in FIG. 7 is different from the variant of FIG. 6 by the only fact that the male guiding means of the lower panels 31 and 32 are directed towards the outside of the wall.

As this is understood, the invention is not restricted to the embodiments shown and described in detail, but on the contrary is extended to the manufacture of any pre-fabricated wall, the adaptations possibly made by a man skilled in the art, for any special application comprising the features of the invention as hereinafter claimed and explained in the above description, must be considered as within the scope of the present invention.

I claim:

1. An arrangement for erecting a pre-fabricated wall, comprising a section having a T-shaped wing in configuration placed parallel to said wall, including an I-shaped section having a web and two wings, a C-shaped section with a plane web and two wings having respective ends comprising a portion bent parallel to the web of said C-shaped section, one of the wings of the I-shaped section being slidably engageable inside the C-shaped section in such a way that said ends constitute, with the web of the I-shaped section and the inner surface of the wing of said section when engaged in the C-shaped section, at least one groove-shaped interval, and a substantially plane element provided at least at one of the ends thereof with a guiding means angularly placed to a wall of said substantially plane element, said substantially plane element being engaged between the wings of the I-shaped section in such a way that said guiding means is engaged in said groove when a wall of said element opposite the wall provided with said guiding means is brought in contact with the wing of the I-shaped section opposite the wing engaged in the C-shaped section.

2. An arrangement for erecting a pre-fabricated wall, comprising a section having a T-shaped wing in a configuration placed parallel to said wall, including an I-shaped section having a web and two wings, a C-shaped section with a plane web and two wings having respective ends comprising a portion bent parallel to the web of said C-shaped section, one of the wings of the I-shaped section being slidably engageable inside the C-shaped section in such a way that said ends constitute, with the web of the I-shaped section and the inner surface of the wing of said section when engaged in the C-shaped section, at least at one of the ends thereof with a guiding means angularly placed to a wall of said substantially plane element, said substantially plane element being engaged between the wings of the I-shaped section in such a way that said guiding means is engaged in said groove when a wall of said element opposite the wall provided with said guiding means is brought in contact with the wing of the I-shaped section opposite the wing engaged in the C-shaped section, said guiding means being constituted by a retractable element.

3. The arrangement set forth in claim 2, wherein said wall comprises a plurality of I-shaped sections and a plurality of substantially plane elements placed between said I-shaped sections, each of said I-shaped sections cooperating with at least one C-shaped section to constitute on each side of the web of said I-shaped section respectively a groove shaped interval in which is engaged the guiding means of one of said elements.

4. The arrangement set forth in claim 2, wherein said I-shaped section is fixed to the end of a substantially plane element, the opposite end of said substantially plane element comprising said guiding means section.

5. The arrangement set forth in claim 2, wherein the C-shaped section comprises a strutting and staying means, said means being fixedly mounted against the outer side of the web of said C-shaped section.

6. The arrangement set forth in claim 5, wherein said strutting and staying means is constituted by a strut of an adjustable length and fixedly mounted at the two ends thereof against the outer sides of two C-shaped sections, to constitute two opposite walls spaced of a distance substantially corresponding to the length of the strut.

7. The arrangement set forth in claim 4, wherein said substantially plane element comprises, at a given distance from its two ends, a section having appearing wing placed parallel to the end section and in the appearing wing of which is engageable a C-shaped section fixed at one end of a strut.

8. The arrangement set forth in claim 2, wherein the C-shaped section is slidable along the wing of the I-shaped section with which it cooperates and wherein said C-shaped section can be blocked in a determined position by means of the provision of tightening means.

9. The arrangement set forth in claim 8, wherein the C-shaped section is blocked in a position determined by the extension of the strut, said opposite walls bearing against a solid medium.

10. The arrangement set forth in claim 9, wherein said bearing medium is constituted by the wall of a trench made in a ground.

11. The arrangement set forth in claim 2, wherein the C-shaped section is associated with a further plane web C-shaped section with the webs of the sections placed in front of each other, whereby said further C-shaped section constitutes a female guiding means for the wing of a I-shaped or T-shaped section and can cooperate with the web of said I-shaped or T-shaped section to constitute a guiding groove able to receive a male guiding means located at the end of a substantially plane element of the wall.

* * * * *